US006508694B2

(12) United States Patent
Korovin

(10) Patent No.: US 6,508,694 B2
(45) Date of Patent: Jan. 21, 2003

(54) MULTI-ZONE PRESSURE CONTROL CARRIER

(75) Inventor: Nikolay Korovin, Phoenix, AZ (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 20 days.

(21) Appl. No.: 09/761,336

(22) Filed: Jan. 16, 2001

(65) Prior Publication Data

US 2002/0094759 A1 Jul. 18, 2002

(51) Int. Cl.[7] ..... B24B 1/00

(52) U.S. Cl. ..... 451/41; 451/287; 451/288; 451/289; 451/364; 451/388; 451/397

(58) Field of Search ..... 451/287, 41, 288, 451/289, 364, 388, 397, 398

(56) References Cited

U.S. PATENT DOCUMENTS

| | | | | |
|---|---|---|---|---|
| 3,848,327 | A | | 11/1974 | Gerber et al. |
| 4,131,267 | A | | 12/1978 | Ono et al. |
| 4,392,915 | A | | 7/1983 | Zajac |
| 4,768,763 | A | | 9/1988 | Gerber |
| 4,828,238 | A | | 5/1989 | Mozieka et al. |
| 5,141,212 | A | | 8/1992 | Beeding |
| 5,439,205 | A | | 8/1995 | Häberle |
| 5,554,064 | A | | 9/1996 | Breivogel et al. |
| 5,605,488 | A | * | 2/1997 | Ohashi et al. ..... 451/7 |
| 5,720,845 | A | * | 2/1998 | Liu ..... 156/345 |
| 5,772,170 | A | | 6/1998 | Tsukushi |
| 6,024,631 | A | | 2/2000 | Piper |
| 6,080,050 | A | | 6/2000 | Chen et al. |
| 6,093,089 | A | | 7/2000 | Chen et al. |
| 6,135,858 | A | | 10/2000 | Takahashi |

* cited by examiner

*Primary Examiner*—Joseph J. Hail, III
*Assistant Examiner*—Shantese McDonald
(74) *Attorney, Agent, or Firm*—Snell & Wilmer, L.L.P.

(57) ABSTRACT

A multi-zoned carrier for a chemical-mechanical planarization (CMP) polishing device includes a center cell, a middle cell, and an outer cell. Each of the cells are in fluid communication with each other through multiple conduits equipped with flow restrictors. The combination of cells and conduits allows more uniformity and planarity to be achieved during the chemical-mechanical planarization (CMP) polishing process.

15 Claims, 7 Drawing Sheets

MULTI-ZONE PRESSURE CONTROL CARRIER

FIELD OF THE INVENTION

The present invention relates to chemical-mechanical polishing (CMP) tools, and more particularly, to carriers for holding semiconductor wafers during polishing periods, and specifically to controlling the pressure applied by carriers.

BACKGROUND

Chemical mechanical polishing (CMP) tools are typically used to planarize the surface of a semiconductor wafer or to remove the upper portion of a layer formed on the semiconductor wafer through any one of a variety of processes, for example damascene processes. Some conventional CMP tools also include a rotating or non-rotating carrier to hold a wafer, and a rotating or orbiting platen or table with a polish pad. The CMP tool causes the polish pad and the wafer surface to come into contact, typically applying a specified pressure between the polish pad and the wafer surface. The CMP tool also imparts a relative motion between the wafer surface and the polish pad. Additionally, the CMP tool typically introduces slurry at the interface between the polish pad and the wafer surface, although some abrasive pads do not require slurry. The slurry can have abrasive particles suspended in a chemical solution that react with selected materials on the wafer surface. The pressure, slurry and relative motion effectuate the polishing.

This planarization or polishing is commonly accomplished by securing the wafer to a carrier, rotating the carrier and placing the rotating wafer in contact with a polishing pad mounted on a platen. A conventional wafer carrier typically includes a hard flat plate that is rigid and so does not conform to the surface of the wafer. The plate surface is therefore covered by a softer carrier film that allows the hard plate to apply a more uniform pressure across the surface of the wafer. This process is known in the industry as back referencing technology. Back referencing has not been entirely successful in that any inconsistencies between the backside of the wafer and the carrier film are translated to the front of the wafer by virtue of the direct contact and the flexibility of the wafer.

In an effort to reduce the amount of non-uniformity caused by the back referencing technology, other systems use an inflatable bladder instead of the soft carrier film. The inflated bladder is apparently intended to absorb the imperfections from the backside of the wafer. This process is known in the industry as "front referencing technology."

Non-uniform planarization can occur even when uniform pressure is applied to the front surface of the wafer. Non-uniform slurry distribution and the result of different polishing motions applied to different areas of the wafer surface are the most common examples. The non-uniform planarization results are typically manifested as concentric bands on the front surface of the wafer that reflect differences in material removal rate.

What is needed is a carrier in wafer surface topology that reduces the inconsistencies associated with back referencing technology and certain types of front referencing technology.

SUMMARY

This summary of the Invention section is intended to introduce the reader to aspects of the invention and is not a complete description of the invention. Particular aspects of the invention are pointed out in other sections herein below and the invention is set forth in the appended claims, which alone demarcate its scope.

In accordance with the aspects of the present invention, a multi-zoned pressure control carrier for use in a CMP tool is provided. This front referencing carrier permits polishing of wafers so the inconsistencies inherent in utilizing multi-zone technology (i.e. the shear force or gradient problems discussed below) can be compensated for and reduced to acceptable levels in addition to allowing for polishing profiles that require multi-zone polishing. Additionally, because the present invention is a "front referencing carrier", it also provides a solution to back side wafer inconsistencies.

In one embodiment of the present invention, the multi-zoned carrier includes several cells, for example, a center cell, a middle cell and an outer cell. The middle cell might be in fluid communication with the center cell and the outer cell via conduits supplied with flow restrictors, for example, flow orifices. Either the center cell or outer cell is in direct fluid communication with an air supply (or supply of other gaseous fluid), so that one cell receives pressure from the supply while the other cell operates as an outlet. During the polishing process, the volume of air received from the supply, in conjunction with the selected flow restrictor type, determines the pressure in each of the cells, which in turn establishes a polishing profile.

In one example, during operation the center cell receives a volume of fluid and its internal pressure increases to above that of the middle cell to which it is linked by a passage with a conduit and its accompanying flow restrictor. The fluid then attempts to flow to the middle cell through the restrictor-equipped conduit to stabilize the pressure relationship between the two cells. Similarly, once pressure in the middle cell exceeds that of the outer cell, fluid would then attempt to flow into the outer cell, via the restrictor-equipped conduits that interconnect the middle cell and the outer cell until the pressures in all cells are stabilized. The advantage of this apparatus is that if at any time during the process a pressure were to be applied to a cell, for example an inconsistency on the backside surface of a workpiece or wafer, the cell affected could absorb the displacement and due to the properties inherent in fluids, distribute the pressure increase with the interconnected cells. Thus, instead of an inconsistency being forced through a workpiece from the backside surface to the front surface, the inconsistency could be absorbed into the cell due to the fluid displacement allowed by the interconnectivity of the cells.

The cells may each have differing pressures due to polishing profile requirements. For example, one cell might be controlled at a higher pressure, through flow restrictor sizing and fluid flow rates, than another cell. That difference could manifest itself as a pressure gradient between the cells. In this scenario, a middle cell may be interspersed between an inner and outer cell to reduce the pressure gradient between the inner and outer cells.

To obtain a desired polishing profile the interconnections between the cells might include conduits with devices that have controllably variable resistance to fluid flow, for example a needle valve. The appropriate selection of the flow resistance of the conduits allows for maintaining differing pressures between cells, yet still permits fluid communication between the cells. Thus, the middle cell in this embodiment could then be used to reduce the pressure gradient between the center and outer cells and thereby potentially reduce non-uniform planarization results in CMP.

In another embodiment fluid flow is reversed. In this embodiment the outer cell is pressurized from the supply while the center cell operates as an outlet.

Depending on the desired polishing profile, any one of a variety of flow restrictors may be employed to control the rate of fluid flow. Some flow restrictor options include single, porous, and tunable orifices. These various restrictors, coupled with fluid flow rate and pressure selection, allow process engineers to "tune" a carrier for a specific polishing profile.

BRIEF DESCRIPTION OF THE DRAWINGS

The foregoing embodiments and many of the attendant advantages of this invention will become more readily appreciated by reference to the following detailed description, when taken in conjunction with the accompanying illustrative drawings that are not necessarily to scale, wherein.

DETAILED DESCRIPTION

This section illustrates aspects of the invention, and points out certain preferred embodiments of these aspects. This section is not intended to be exhaustive, but rather to inform and teach the person of skill in the art who will come to appreciate more fully other aspects, equivalents, and possibilities presented by the invention, and hence the scope of the invention as set forth in the claims, which alone limit its scope.

The present invention represents a significant departure from conventional front referencing carrier technology employed in CMP tools by providing multiple zones, each having a controlled pressure, which are in fluid communication with one another via conduits equipped with flow restrictors. The system provides a continuous flow of fluid from high-pressure regions to low-pressure regions that potentially increases both uniformity and planarity of the polishing process. In a further refinement, the flow restrictors can be selected from any of a variety of commercially available types, thereby allowing the process engineer to "tune" a carrier, that is, to fix the pressure levels of each of the cells for a specific polishing process. This multi-zoned carrier technology is detailed below.

Figure 1:
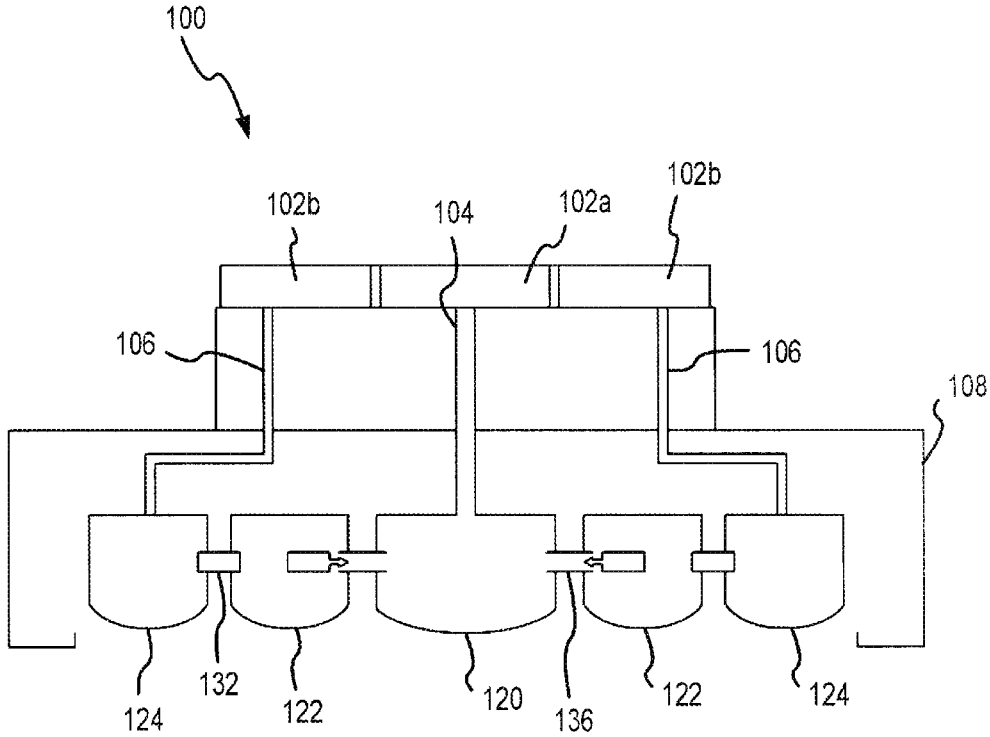
FIG. 1 is a schematic cross sectional front view illustrating a CMP polishing tool carrier featuring a back referencing multi-zoned carrier.
Figure 2:
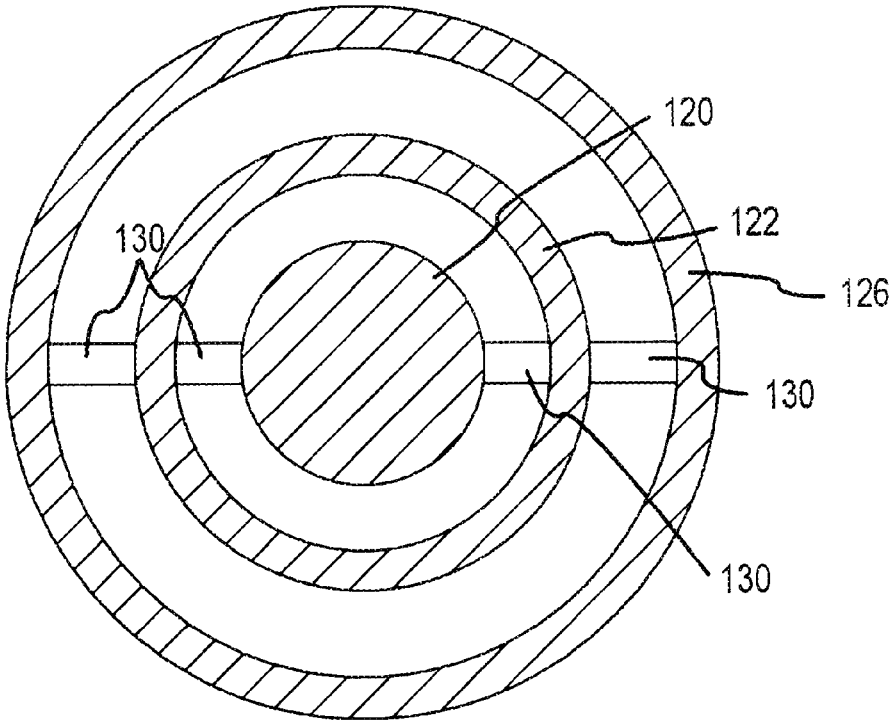
FIG. 2 is a cross-sectional view of the multi-zoned carrier and conduits.

FIGS. 1 and 2 illustrate one embodiment of CMP carrier assembly 100 in accordance with the invention that has multiple cells located within carrier 108. In this embodiment, conduit 104 acts as a fluid intake and allows fluid communication between a center cell 120 and air supply 102*a*. The center cell 120, as seen in FIG. 2, comprises a substantially cylindrical bladder, viewed relative to the polishing plane, and is manufactured from a material allowing for flexing under when fluid pressure varies, such as an elastomer type material. The center cell 120 is in fluid communication with a middle cell 122 via multiple conduits 130. Middle cell 122, includes an annular tube surrounding the center cell, and is also manufactured from flexible material. The middle cell 122 is in turn in communication with outer cell 124 via multiple conduits 130. The outer cell 124, in a preferred embodiment, also includes an annular tube that surrounds middle cell 122, and likewise is manufactured from flexible material. Additionally, outer cell 124 is in fluid communication with supply 102*b*, via a pneumatic line 106, which acts as a fluid outlet. The outlet in one embodiment could merely vent the fluid, if it were an inert gas for example, or in another embodiment it could return the fluid if necessitated.

In another embodiment of the present invention, referring to FIGS. 1 and 2, the cells are located in the same manner with the fluid flowing in the opposite direction. That is, pneumatic line 106 would provide communication between the outer cell 124 and the supply 102*b*, and would act as a fluid intake. Pneumatic line 104 would act as a fluid outlet, providing communication between center cell 120 and supply 102. Middle cell 122 would remain in the same position and retain its communication with center cell 120 and outer cell 124 via conduits 130. This embodiment allows for the fluid to flow in the opposite direction, which can be advantageous in certain polishing profiles. While this description refers to three cells or zones, it should be clear to one skilled in the art that more than 3 interconnected cells may be used, with 6 to 8 being the preferred range.

In yet another embodiment the flow restrictors are located outside the carrier. In this embodiment each cell is in fluid communication with another cell via a pneumatic line connected to an orifice having a pneumatic line connected to the other cell. In this embodiment the orifice could be located externally to allow for the use of different orifices during the process.

Additionally, the cells can be manufactured from any suitable flexible material that is resistant to process chemicals. Materials for cell manufacturing include ethylene-propylene-diene monomer (EPDM), natural rubber, and Mylar®, with EPDM being preferred. An example of which may be obtained from R. E. Darling, located at Tucson, Ariz.

During operation, fluid flows between cells (as discussed above) in an attempt to stabilize the pressure in all cells. Thus, when any of the cells come into contact with a raised inconsistency on the backside surface of a workpiece, pressure in that cell increases. To reduce the pressure fluid flows out of the cell and into an adjoining lower pressure cell. Therefore, instead of forcing the inconsistency through the backside of the workpiece and hence to the front surface, where the irregularity would result in deviation from a desired surface polish profile, the inconsistency is displaced into the cell and therefore not manifested on the wafer surface.

The invention identifies and solves a problem in the art. Carriers providing different pressures on each of several concentric bands generally accomplish this by having two or more bladders (also referred to as "cells" or "zones") that may be individually pressurized and separated by one or more barriers. However, these carriers typically have a discontinuity of pressure at the interface between the zones near the barrier. This discontinuity is generally caused by the barrier experiencing a shear force (also referred to as a "gradient") due to the different pressures within the adjacent bladders changing over a short distance (i.e. the thickness of the barrier). This pressure difference can lead to inconsistencies on the workpiece surface due to different polishing rates produced by the different pressures. One solution to this problem presented by the inventor is the use of an intermediate cell or cells, such as a third cell placed between the center cell 120 and the outer cell 124 as detailed above. This middle cell 122 could be pressurized, using the aforementioned conduit and flow restrictors, at an amount somewhere between the pressures maintained in the center cell 120 and outer cell 124 resulting in the potential reduction of the gradient. Using additional cells may allow for an increase in distance over which the pressure is decreased, reducing the gradient as well.

Moreover, (referring to FIG. 2) it may be desirable to establish a specific gradient between cells to achieve a required polishing profile. Thus, by suitable selection of supply pressure and conduit types and sizes, a reduced pressure gradient(s) between the center 120 and outer 124 cells may be established and maintained via the use of a middle cell 122. During operation the pressure supplied to the center cell 120 and outer cell 124, depending on the embodiment used, can range from about 0 psi to about 10 psi with the preferred range from about 0 psi to about 6 psi depending on the desired polishing profile. The middle cell 122 pressure can range from about 0 psi to about 10 psi with the desired range being from about 0 psi to about 6 psi.

It should be noted that with the large number of variables in this procedure, a desired pressure gradient between cells may be obtained through a variety of pressure, fluid flow rate and flow restrictor combinations.

Furthermore, in certain applications it is desirable to have a [given] pressure gradient between the zones to control effects in CMP. In these instances the operator can implement the selected types and sizes of flow restrictors to achieve the desired polishing profile.

The restrictors previously referred to and illustrated in FIG. 1 can include but are not limited to a single orifice 132, a tunable orifice 136, or any combination thereof. The single orifice 132 in this embodiment has limited controlled restriction of fluid flow. The tunable orifice 136 in this embodiment is controllable and allows for controlled variation of fluid flow restriction, for example a needle valve. The center cell 122, in this preferred embodiment, can utilize the aforementioned orifices in any combination required to meet the desired polishing profile. Additionally, the orifices listed are not exhaustive of the conduits available and useful.

The multi-zone carrier of the invention is useful in a wide range of CMP tools, including but not limited to orbital polishers, for example, U.S. Pat. No. 5,554,064 entitled "Orbital Motion Chemical-Mechanical Polishing Apparatus and Method of Fabrication," discloses an orbital chemical-mechanical polishing apparatus, and is hereby incorporated by reference to the extent pertinent. An improved CMP machine disclosed in our copending U.S. Ser. No. 09/153,993, filed Sep. 17, 1998 adds an additional type of motion to the polishing pad of the apparatus: namely, rotation or oscillation achieved by rotating the platen with its polishing pad, in the preferred embodiment, in alternating clockwise and counterclockwise directions. These rotations or oscillations of the platen with its polishing pad during CMP enhance the polished wafer surface by reducing polish variations as compared to a surface obtained using orbital motion only.

Figure 3:
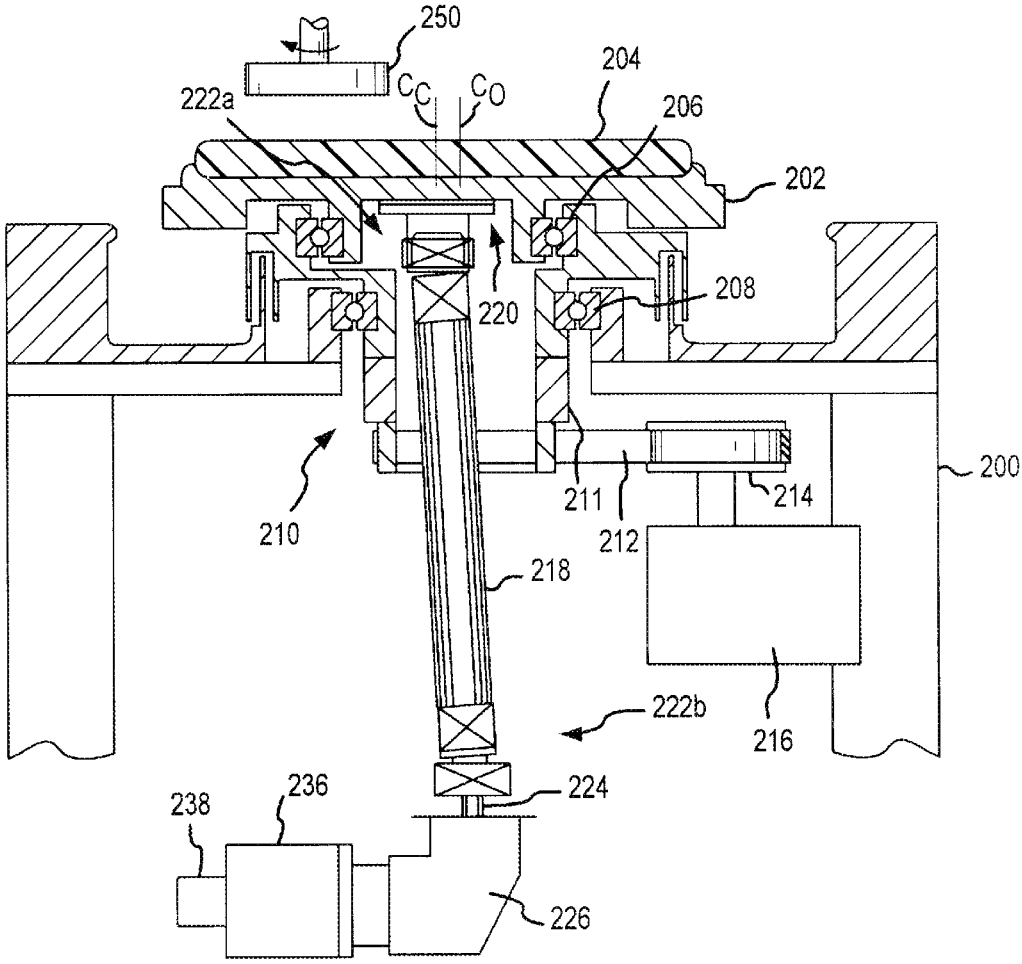
FIG. 3 is a schematic partial side view in cross section of a CMP apparatus using a multi-zone wafer carrier.

This type of CMP apparatus is shown in FIG. 3, and is modified by addition of a multi-zone carrier. Thus the apparatus includes a frame 200 of the present invention onto which is mounted a platen 202 that is equipped with a polishing pad 204. The apparatus includes a pair of rotary bearings, the upper rotary bearing 206 is fixedly mounted to an underside of the platen 202, and a rotatable "wave generator" 210 that includes a substantially cylindrical sleeve 211 extending downward under the platen 202. A first central axis Co of the upper rotary bearing 206 of the wave generator 210 is offset from the second central axis Cc of the lower rotary bearing 208. The lower rotary bearing 208 is fixedly mounted to the lower portion of sleeve 211, and to the supporting frame 200 of the apparatus. Thus, when the wave generator 210 is brought into rotational motion, the first central axis Co of the upper rotary being 206 is equal to the parallel offset between the first central axis Co and the second central axis Cc. This causes the platen 202 and pad to orbit. As indicated in FIG. 3, rotary motion is imparted to the wave generator 210 by means of a drive belt 212 that embraces sleeve 211 and that extends over a pulley 214 coupled to a drive motor 216. More detail about the orbital motion is found in U.S. Pat. No. 5,554,064 previously incorporated by reference.

A shaft 218 extends from an underside of the platen 202 where it is fixedly attached, through the annular space of the sleeve 211 of the wave generator 210 downward to a mechanism for imparting rotary or oscillatory motion to the platen 202. The shaft 218 includes an upper pedestal 220 fixedly attached to the underside of platen 202. Extending downward from the upper pedestal 220, the shaft included an upper universal joint 222*a* and a lower universal joint 222*b*, spaced from the upper universal joint 222*a*.

A variety of mechanisms that may be used to impart rotational or oscillatory motion will become clear to one of skill in the art who has read this disclosure. In the preferred embodiment of FIG. 3, a drive shaft 224 is coupled to the lower universal joint 222*b* at one of its ends, and to gear box 226 at its other end. The axis of drive shaft 224 is along the same axis of rotation of the second center axis Cc of the lower rotary bearing. The gearbox is driven by a step motor 236, which is controlled by a motor controller 238. The motor controller controls the degree of rotation imparted by the motor to shaft 224. Thus, by adjusting the motor controller, the arc may by varied within the range from about −360 to about +360 degrees for oscillatory motion. For rotational motion, the motor may be allowed to continuously rotate shaft 224 thereby causing continuous rotation of pad 204.

Figure 4:
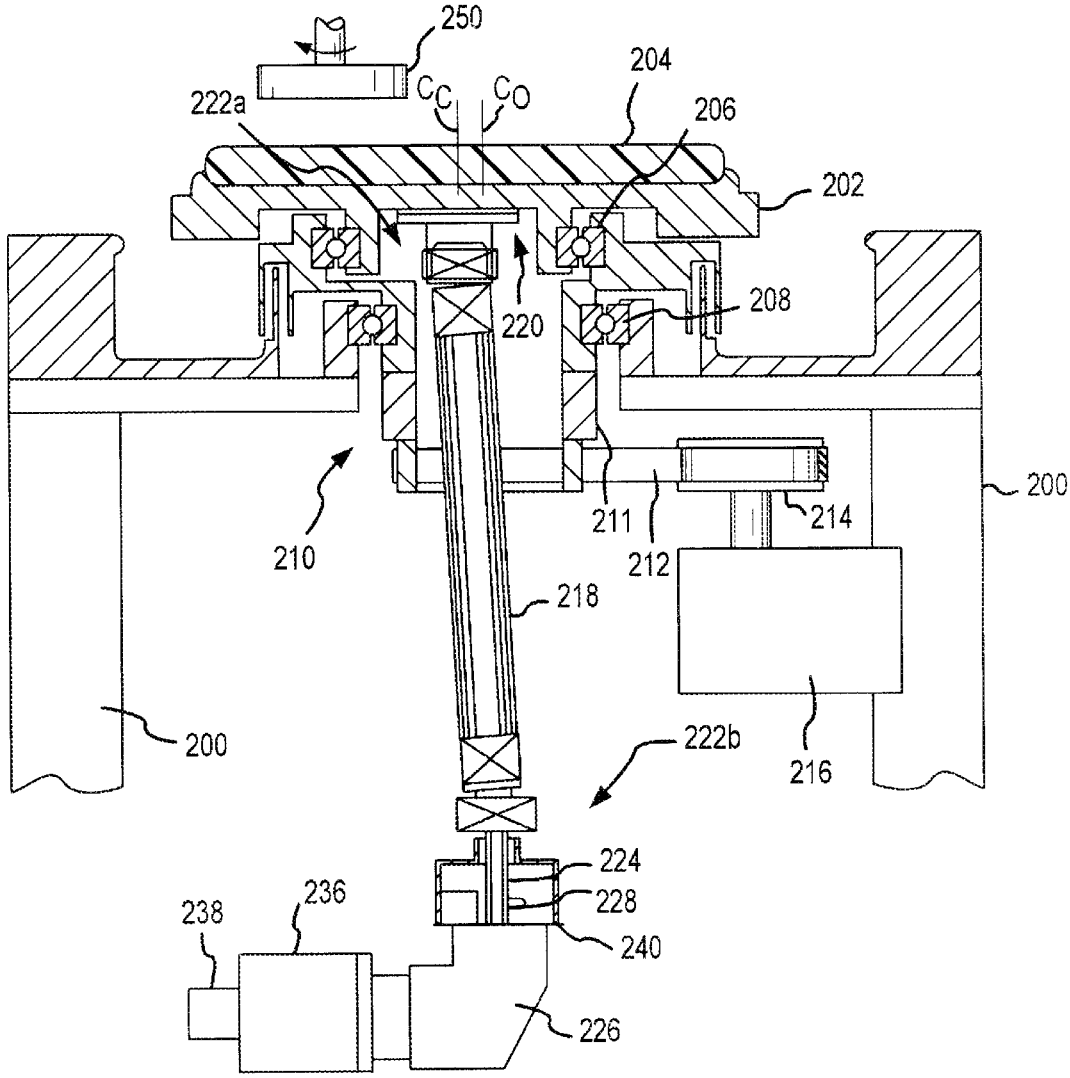
FIG. 4 is a schematic partial side view in cross section of another apparatus using a multi-zone wafer carrier.
Figure 5:
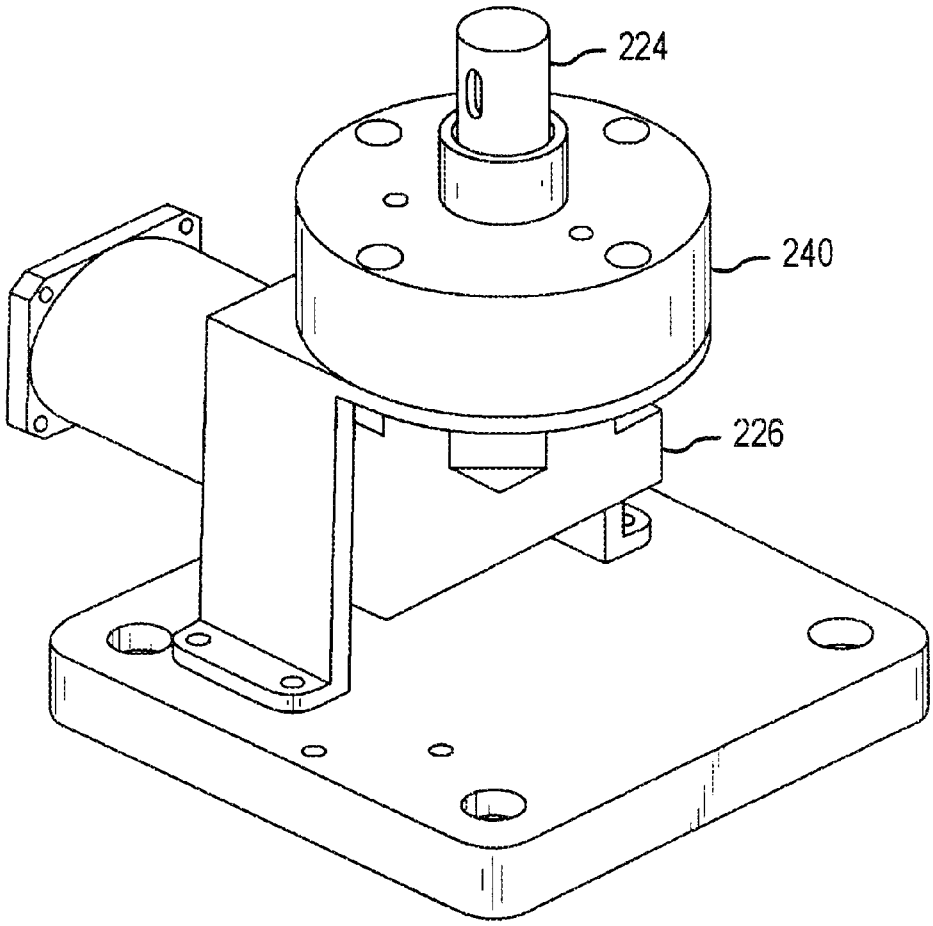
FIG. 5 is a perspective view of the apparatus of FIG. 4 required to impart oscillatory motion to an orbiting platen.
Figure 6:
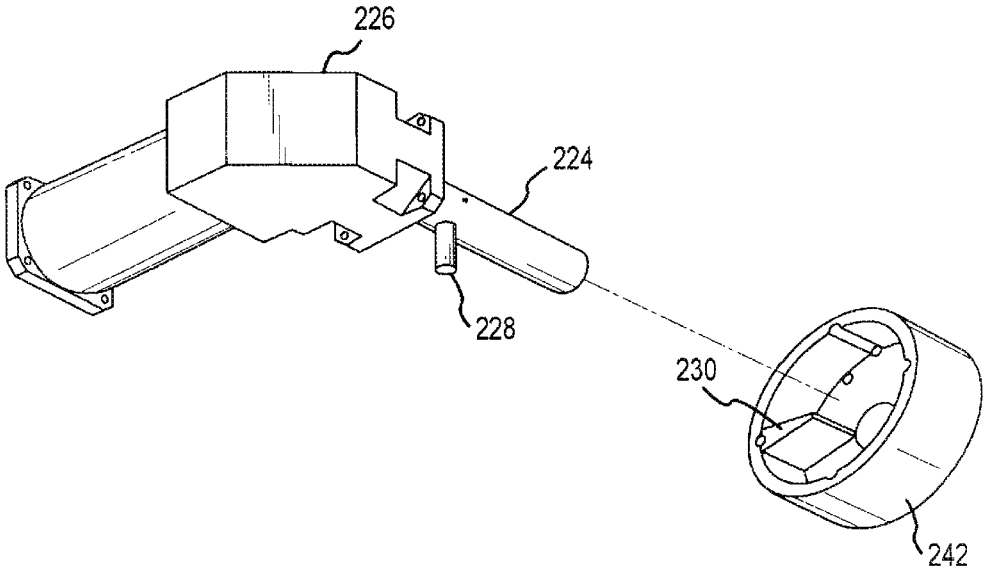
FIG. 6 is a schematic partially exploded view showing mechanical top details to CMP tool of FIG. 5 for providing oscillatory motion to orbiting platen.
Figure 7:
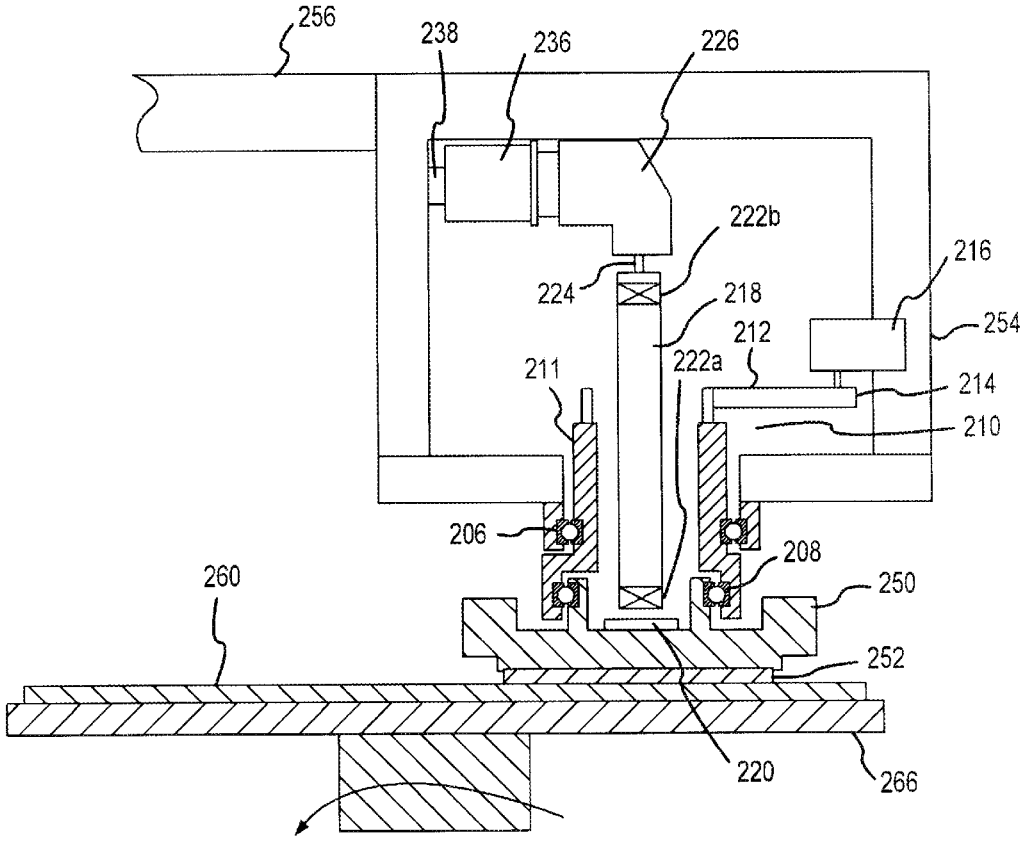
FIG. 7 is a schematic illustration showing a side view, in partial cross-section to show details of an alternative CMP tool, wherein a multi-zone wafer carrier is equipped to both oscillate and orbit, to rotate and orbit, against a polishing pad mounted to a platen that is either stationary or rotating.

Other mechanisms may also be utilized to impart oscillatory (partial rotational movement) or rotational movement to the pad 204. For example, in the alternative embodiment of the invention shown in FIG. 4, oscillatory motion is produced by a combination of a drive motor and mechanical and electrical stops that cause the shaft to move in alternate counterclockwise and clockwise motion, limited by the mechanical stop. Thus, referring to FIGS. 3, 5, 6 and 7, a substantially vertical shaft 224 is coupled to and extends downward from below the lower universal joint 222*b*, and into a hard stop box 240. As shown, the shaft 224 has a radial leg 228 that sweeps the interior of surrounding cap 242 when the shaft 224 is rotated. To limit rotation of shaft 224, one or more mechanical stops are placed in the cap 242 to arrest rotational movement of the shaft by blocking movement of the radial leg. A pair of electrical sensors or stops (not shown) are located on the outside of each side of the mechanical stop 230 so that the radial leg 228 will encounter the electrical stops before being blocked by the mechanical stop.

A motor 236, able to impart rotary motion, is mounted to a supporting frame 200 of the apparatus, and is mechanically coupled to the gear box 226. Thus, the motor 236 through gear box 226 rotates shaft 224 and, hence, shaft 218 counterclockwise, thereby causing the platen to rotate in the same direction, until the radial leg 228 of the shaft 224 is stopped by the mechanical stop 230. Then, due to electrical contact with electrical sensor 232, direction of the rotation is reversed to a clockwise direction. Again, shaft 218 and platen 202 also rotate clockwise until the radial leg 228 of shaft 224 is limited by mechanical stop 230. Contact with the other electrical stop 232 causes reversal of the rotational movement, as described above. Thus, the apparatus provides clockwise and counterclockwise oscillatory movement in an arc determined by the location of the mechanical stop.

The pad is simultaneously subject to at least partial rotational movement and orbital movement. For complete rotational movement, in those apparatus where the supply of polishing slurry is applied through the pad, the slurry supply lines (and other supply lines) should be supplied with rotatable couplings so that the supply lines do not twist around the shaft. Obviously, for partial rotational movement or oscillation, such rotational couplings may not be needed, as long as the supply lines are of adequate length.

In an embodiment, developed for polishing standard 8 and 12-inch wafers, the platen and pad orbit such that the locus of the center of the pad describes a circle with a diameter from about ½ of the wafer diameter to about 0.1 inches (2.54 mm) with the preferred orbit diameter of 1.25 inches (31.75 mm). The center of orbit of the carrier is offset from the center of the orbit of the platen by from about 0 to about 1 inch (25.4 mm) with a preferred offset of about 0.375 inches (9.54 mm).

Typically, the pad and platen orbit at speeds of at least 300 revolutions per minute, more preferably in the range 300–600 revolutions per minute, but the range can be as much as 200–2000 revolutions per minute. The multi-zone wafer carrier 250 may rotate or oscillate about its axis or remain stationary.

The polishing pad may be rotated or oscillated an integral number of times during each polish cycle. The duration of a polish cycle depends upon several factors, and typically varies in the range from about one to about four minutes. It is preferred to have from about 1 to about 6 complete oscillations per polish cycle.

While the arc through which the polish pad 204 rotates or oscillates may vary, it is preferred to oscillate continuously. It should preferable be able to oscillate through the range from about −180 degrees (counterclockwise) to about +180 degrees (clockwise). Oscillatory motion in the region from about −135 degrees to about +135 degrees is useful, but lesser or greater angular rotation may also be beneficial.

It will be readily apparent that in the above CMP tool, the surface of a semiconductor substrate being polished may be subjected to a combination of several kinds of motion, depending upon mode of operation of the apparatus. For example, when the platen both orbits and oscillates, and the multi-zone wafer carrier rotates, the wafer surface is subjected to orbital, rotational and oscillating polishing movement. On the other hand, when the platen orbits and rotates, while the multi-zone wafer carrier rotates, the wafer surface is subjected to orbital polishing movement along with two kinds of rotational polishing movement. When the multi-zone wafer carrier is stationary, the wafer surface is subjected to either orbital and rotational polishing movement, or orbital and oscillating polishing movement, depending upon mode of operation of the apparatus.

In accordance with term usage of this document, "an oscillating polishing movement: refers to movement of the device (multi-zone carrier or platen) and not the actual movement experienced (or traced) by a locus on the wafer surface; the same applies to "linear", "rotational", "sweeping" and "orbital polishing movements".

It will be readily apparent to one of skill in the art who has read this disclosure, that mode of movement of the multi-zone carrier and platen can be reversed, i.e., the multi-zone wafer carrier may be equipped with mechanical means to generate orbital and either oscillating or rotational movement; while the platen may be retained stationary or may rotate. Accordingly, the platen can also be used in an apparatus for carrying out this "reverse" application of polishing movement, through the embodiment illustrated in FIG. 7. Since many of the component parts of the apparatus are similar to that of the above-described embodiment, the same numerals are used for simplicity. In this instance, the multi-zone wafer carrier 250 is linked to a wave generator 210 that is similar to the wave generator described above in that it is comprised of two bearings, 206 and 208, which are spaced vertically from each other, and with centers of rotation offset. The lower bearing 208 is mounted to a support structure, such as the housing 254, which is in turn supported by a support structure 256. One end of the wave generator has a cylindrical sleeve 211, which is driven by a belt 212 that passes over a drive pulley 214 of an electrical motor 216, which preferably has speed control. Once again, a central shaft 218 extends in the annular space of the wave generator and the pedestal 220 at its lower end is mounted to the upper surface of the multi-zone wafer carrier 250. The shaft 218 is equipped with at least two universal joints, 222*a* and 222*b*, one at each of its ends. A drive shaft 224 is mounted to an upper end of the shaft 218, above the upper universal joint 222*b*, and is driven through gear box 226 by motor 236, which is in turn controlled by motor controller 238. Thus, the apparatus for imparting orbital and rotational or oscillating movement to the multi-zone wafer carrier 250 is similar to the apparatus described above for imparting such motion to the polishing pad platen of the invention.

In this instance, the multi-zone wafer carrier 250, when it contains a wafer 252, is brought into contact with the pad 260, which is supported on platen 266, which may rotate or which may be held stationary. When the platen rotates, the pad sweeps across the face of the wafer being polished in a "sweeping motion." At the same time, operation of the above-described apparatus imparts an orbital motion to the multi-zone wafer carrier 250 (and hence to the wafer 252) along with either complete rotation of the multi-zone carrier around its central axis, or oscillation about that access. Thus, the apparatus provides for several permutations of polishing movement on the surface of the wafer: (1) orbital, rotational and sweeping polishing movement; (2) orbital, oscillation and sweeping polishing movement; (3) orbital and oscillating polishing movement; and (4) orbital and rotational polishing movement.

Although the description above refers to wafers, other embodiments of the present invention can be adapted for other types of workpieces. For example, a workpiece may be semiconductor wafer, a bare silicon or other semiconductor substrate with or without active devices or circuitry, a partially processed wafer, a silicon or insulator structure, a hybrid assembly, a flat panel display, a micro electromechanical structure (MEMS), a disk for a hard drive memory, or any other material that would benefit from cleaning or planarization.

The foregoing description provides an enabling disclosure of the invention, which is not limited by the description but only by the scope of the appended claims. All those other aspects of the invention that will become apparent to a person of skill in the art, who has read the foregoing, are within the scope of the invention and of the claims herebelow.

I claim:

1. A carrier assembly for use in a chemical mechanical polishing apparatus, the assembly comprising:

(a) a first cell comprising a first flexible outer membrane;

(b) an adjacent second cell comprising a second flexible outer membrane, the second cell in fluid communication with the first cell; and (c) a third cell adjacent the second cell comprising a third flexible outer membrane, the third cell in fluid communication with the first and second cells, a lower surface of the third cell substantially coplanar with lower surfaces of the first and second cells.

2. The carrier of claim 1, further comprising:

(a) a first conduit extending between the first and the second cell, the first conduit comprising a flow restrictor; and (b) a second conduit extending between the second and the third cell, the second conduit comprising a flow restrictor.

3. The flow restrictor of claim 2, wherein the flow restrictor is a tunable orifice.

4. The carrier of claim 1, wherein the first cell comprises a substantially cylindrical shape.

5. The carrier of claim 1, wherein the second and third cells comprise annular concentric tubes, with a common center with the first cell.

6. A carrier assembly for use in a chemical mechanical polishing apparatus, the assembly comprising:

(a) a first cell comprising a first bladder, having a substantially cylindrical shape;

(b) a second cell adjacent to and at least partially surrounding the first cell, the second cell comprising a second bladder, the second bladder in fluid communication with the first bladder;

(c) a third cell adjacent to and at least partially surrounding the second cell, the third cell comprising a third bladder, the third bladder in fluid communication with the second bladder;

(d) a first conduit connecting the first and second cells, the first conduit comprising a first flow restrictor; and (e) a second conduit connecting the second and third cells, the second conduit comprising a second flow restrictor.

7. The carrier of claim 6, wherein the first and second flow restrictors comprise orifices.

8. The carrier of claim 6 wherein the first and second restrictors each further comprise a diaphragm, the diaphragm adjustable for fluid flow therethrough.

9. A method for polishing a workpiece utilizing a chemical mechanical polishing carrier assembly, the system comprising:

(a) loading a workpiece into the carrier assembly, the carrier assembly having a plurality of pressure adjustable concentric bladders, the bladders in fluid communication with adjacent bladders via conduits;

(b) determining a removal rate profile for a plurality of concentric zones on a workpiece that correspond to the plurality of concentric bladders of the carrier;

(c) implementing the removal rate profile by controlling flow in the conduits and applying a desired pressure to the bladders;

(d) causing the workpiece to contact a polishing surface; and (e) polishing the workpiece.

10. The method of claim 9, wherein the conduits comprise flow restrictors.

11. The method of claim 10, wherein the flow restrictors comprise orifices.

12. The method of claim 10, wherein the flow restrictors further comprise a diaphragm, the diaphragm adjustable for fluid flow therethrough.

13. The method of claim 9 wherein the plurality of bladders comprises:

a) a first cell comprising a first flexible outer membrane;

b) a second cell comprising a second flexible outer membrane; and c) a third cell comprising a third flexible outer membrane.

14. The method of claim 13, wherein the first cell further comprises a substantially cylindrical shape.

15. The method of claim 13, wherein the second and third cells further comprise annular concentric tubes, with a common center with the first cell.

* * * * *